US010182666B2

(12) United States Patent
Simon et al.

(10) Patent No.: US 10,182,666 B2
(45) Date of Patent: Jan. 22, 2019

(54) FRAMELESS REFRIGERATED CASE

(71) Applicant: Zero Zone, Inc., North Prairie, WI (US)

(72) Inventors: Paul Simon, Waukesha, WI (US); Eric Gray, Muskego, WI (US); Steve Searl, Crystal Lake, IL (US); David A. Steele, Watertown, WI (US)

(73) Assignee: Zero Zone, Inc., North Prairie, WI (US)

( * ) Notice: Subject to any disclaimer, the term of this patent is extended or adjusted under 35 U.S.C. 154(b) by 0 days.

(21) Appl. No.: 15/294,245

(22) Filed: Oct. 14, 2016

(65) Prior Publication Data

US 2018/0103776 A1 Apr. 19, 2018

(51) Int. Cl.

| | |
|---|---|
| ***A47F 3/04*** | (2006.01) |
| ***A47F 3/06*** | (2006.01) |
| ***F25D 23/02*** | (2006.01) |
| ***F25D 23/08*** | (2006.01) |

(52) U.S. Cl.

CPC ..... *A47F 3/0434* (2013.01); *A47F 3/043* (2013.01); *A47F 3/06* (2013.01); *F25D 23/02* (2013.01); *F25D 23/087* (2013.01); *F25D 2400/06* (2013.01)

(58) Field of Classification Search

CPC ..... A47F 3/0404; A47F 3/0426; A47F 3/043; A47F 3/0434; A47F 3/00; A47F 3/0482; A47F 3/004; F25D 23/00; F25D 23/087; F25D 2323/06; F25D 2400/06;

(Continued)

(56) References Cited

U.S. PATENT DOCUMENTS 3,868,152 A * 2/1975 Dixon ..... F25D 23/06 217/131
4,067,628 A * 1/1978 Sherburn ..... F25D 23/064 220/592.05
4,330,310 A * 5/1982 Tate, Jr. ..... F25D 21/04 312/407

(Continued)

FOREIGN PATENT DOCUMENTS

DE 1208853 B * 1/1966 ..... F16B 12/08
DE 102013214923 A1 * 2/2015 ..... F25D 23/065

(Continued)

OTHER PUBLICATIONS

DE102013214923A1 Translated Description, 12 pages (Year: 2015).*

*Primary Examiner* — Andrew M Roersma
(74) *Attorney, Agent, or Firm* — Michael Best & Friedrich LLP

(57) ABSTRACT

A refrigerated case includes an insulated ceiling member defining the top of a refrigerated space, and an end cap defining a front of the insulated ceiling member. The end cap includes an aperture having an opening at a bottom edge of the end cap. A mullion is arranged substantially normal to the insulated ceiling member. A mullion cap defines a front of the mullion and includes a tongue portion extending above the mullion. The tongue portion is arranged to fit within the aperture. The mullion cap and the end cap cooperate to define a first planar sealing surface. A door is pivotably attached to the refrigerated case and includes a second planar sealing surface that is engageable with the first planar sealing surface when the door is in a closed position to define a substantially air tight seal therebetween.

20 Claims, 8 Drawing Sheets

(58) Field of Classification Search
CPC ..... F25D 23/02; F25D 23/063; F25D 23/065; F25D 2400/04; F25D 23/06; F25D 23/062
See application file for complete search history.

(56) References Cited

U.S. PATENT DOCUMENTS 4,844,975 A * 7/1989 Litzenberger ..... E04C 2/292 428/138
5,720,536 A * 2/1998 Jenkins ..... F25D 23/085 312/401
6,036,292 A * 3/2000 Mandel ..... A47B 95/002 312/236
6,367,223 B1 * 4/2002 Richardson ..... A47F 3/0434 312/116
7,014,283 B2 * 3/2006 Grace ..... F25D 23/062 312/406
7,407,240 B2 * 8/2008 Collins ..... F25D 23/063 312/406.2
7,410,230 B2 * 8/2008 Anderson ..... F25D 23/065 312/401
8,998,354 B2 * 4/2015 Wach ..... A47F 3/043 312/138.1
2008/0211359 A1 * 9/2008 Borgstrom ..... A47F 3/043 312/116
2009/0013710 A1 * 1/2009 Cho ..... F25D 23/062 62/285
2011/0023529 A1 * 2/2011 Kim ..... F25D 23/021 62/441
2011/0304253 A1 * 12/2011 Howington ..... F25D 27/00 312/405

FOREIGN PATENT DOCUMENTS

WO WO 2012025560 A2 * 3/2012 ..... F25D 23/065
WO WO 2012025561 A2 * 3/2012 ..... F25D 23/065

* cited by examiner

FRAMELESS REFRIGERATED CASE

BACKGROUND

The invention relates to a refrigerated case for retail sales and more specifically to a refrigerated case including several glass doors that pivot between an open position and a closed position.

Refrigerated cases are used to display refrigerated goods for sale in grocery stores, convenience stores, and the like. To reduce costs, it is desirable that these refrigerated cases be as efficient as possible. One source of significant inefficiency can be air leakage between the doors and the case.

BRIEF SUMMARY

In one construction, a refrigerated case includes an insulated ceiling member defining a top of a refrigerated space, and an end cap defining a front of the insulated ceiling member. The end cap includes an aperture having an opening at a bottom edge of the end cap. A mullion is arranged substantially normal to the insulated ceiling member. A mullion cap defines a front of the mullion and includes a tongue portion extending above the mullion. The tongue portion is arranged to fit within the aperture. The mullion cap and the end cap cooperate to define a first planar sealing surface. A door is pivotably attached to the refrigerated case and includes a second planar sealing surface that is engageable with the first planar sealing surface when the door is in a closed position to define a substantially air tight seal therebetween.

In another construction, a refrigerated case includes an insulated ceiling member defining a top of a refrigerated space, an insulated floor member defining a bottom of the refrigerated space, a first side wall and a second side wall. Each of the first side wall and the second side wall define a side of the refrigerated space. A mullion is arranged substantially normal to the insulated ceiling member. A top end cap defines a front of the insulated ceiling member, and includes a first end aperture, a second end aperture, and a top mullion aperture, each of the first end aperture, the second end aperture and the top mullion aperture having an opening at a bottom edge of the top end cap. A bottom end cap defines a front of the insulated floor member, and includes a third end aperture, a fourth end aperture, and a bottom mullion aperture, each of the third end aperture, the fourth end aperture and the bottom mullion aperture having an opening at a top edge of the bottom end cap. A mullion cap defines a front of the mullion and includes a top tongue portion extending above the mullion and a bottom tongue portion extending below the mullion, the top tongue portion arranged to fit within the top mullion aperture and the bottom tongue portion arranged to fit within the bottom mullion aperture. A first side wall end cap defines a front of the first side wall, and includes a top first side tongue portion and a bottom first side tongue portion, the top first side tongue portion arranged to fit within the first end aperture and the bottom first side tongue portion arranged to fit within the third end aperture. A second side wall end cap defines a front of the second side wall, and includes a top second side tongue portion and a bottom second side tongue portion, the top second side tongue portion arranged to fit within the second end aperture and the bottom second side tongue portion arranged to fit within the fourth end aperture, the top end cap, the bottom end cap, the mullion cap, the first side wall end cap, and the second side wall end cap cooperating to define a first planar sealing surface. A door is pivotably attached to the refrigerated case and includes a second planar sealing surface. The second planar sealing surface is engageable with the first planar sealing surface when the door is in a closed position to define a substantially air tight seal therebetween.

Other aspects of the invention will become apparent by consideration of the detailed description and accompanying drawings.

BRIEF DESCRIPTION OF THE SEVERAL VIEWS OF THE DRAWINGS

To easily identify the discussion of any particular element or act, the most significant digit or digits in a reference number refer to the figure number in which that element is first introduced.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless specified or limited otherwise, the terms "mounted," "connected," "supported," and "coupled" and variations thereof are used broadly and encompass both direct and indirect mountings, connections, supports, and couplings. Further, "connected" and "coupled" are not restricted to physical or mechanical connections or couplings.

DETAILED DESCRIPTION

Figure 1:
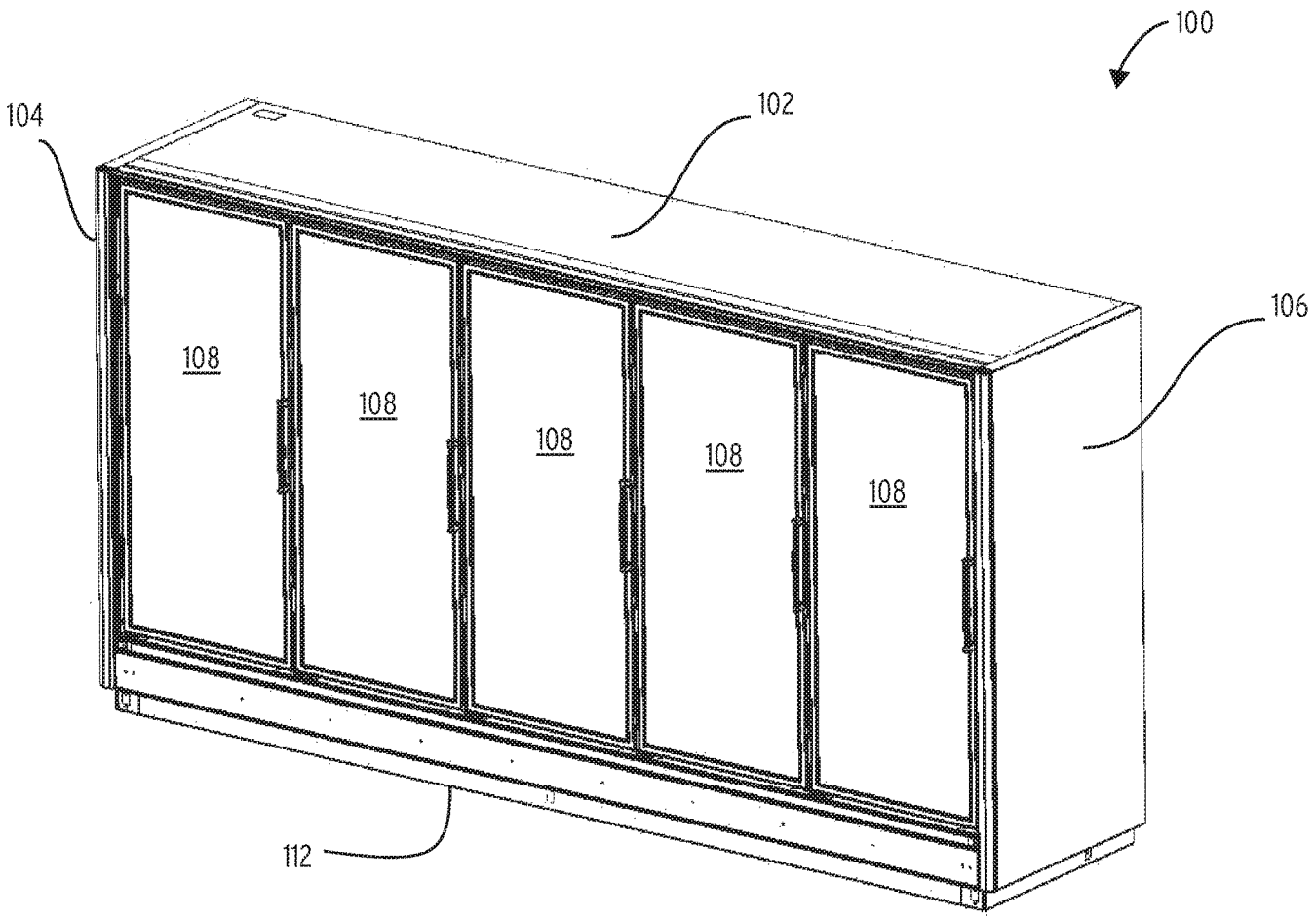
FIG. 1 is a perspective view of a refrigerated case.

FIG. 1 illustrates a refrigerated case 100 that is typically used in a grocery store, convenience store, or other retail location in which refrigerated or frozen goods are sold. It is desirable that the refrigerated case 100 be operable at a high level of efficiency to reduce the cost of refrigerating the goods in the refrigerated case 100 and to assure that those goods do not spoil. The refrigerated case 100 includes a first door 108 and in the illustrated construction four additional doors that are substantially identical to the door 108. The doors 108 provide visual access to the items being sold as well as actual access for a customer to remove items for purchase. The seal between the doors 108 and the remainder of the refrigerated case 100 is an area where significant efficiency losses can occur. It should be noted that while the refrigerated case 100 illustrated in FIG. 1 includes five doors, other constructions may include fewer doors or more doors as may be required for the particular application. In addition, doors of different height or width may be used as may be required by the particular application.

With continued reference to FIG. 1, the refrigerated case 100 includes an insulated ceiling member 102, an insulated first side wall 104, an insulated second side wall 106, and an insulated floor member 112 that cooperate to define a refrigerated space 206 (shown in FIG. 2) that is covered by the door 108 and the other doors in the illustrated construction. The insulated ceiling member 102, insulated first side wall 104, insulated second side wall 106, and insulated floor member 112 are preferably formed from a foam insulating material that provides the necessary insulation to maintain the desired efficiency of the refrigerated case 100. The door 108, like each of the doors, moves (e.g., pivots or rotates) between an open position and a closed position to provide the desired access to the refrigerated space 206. When in the closed position, the door 108 must form a substantially air tight seal with the refrigerated case 100 to maintain the desired efficiency.

For purposes of this application, the term "substantially air tight" should be construed as including a seal between two surfaces that prevents air leakage therebetween for pressure differentials common in a refrigerated case of this type. Typically, a pressure differential of little more than two inches of water (0.07 psi, 0.5 kPa) is present in this application and typically the seal must prevent air flow between two areas having a pressure differential between about zero and two inches of water.

In prior art designs, this seal could only be formed by providing a one-piece frame (typically a welded structure) that attached to the refrigerated case 100 to provide a continuous substantially flat surface that the door 108 could seal against. The term "substantially" when used to describe the flatness of a surface is meant to cover a surface that is formed or machined flat to within standard manufacturing tolerances (e.g., plus or minus 0.020 inches). These frames are very expensive to manufacture as they require special fixtures to hold the components during manufacture as well as skilled craftsman to complete the welding and machining processes.

Figure 2:
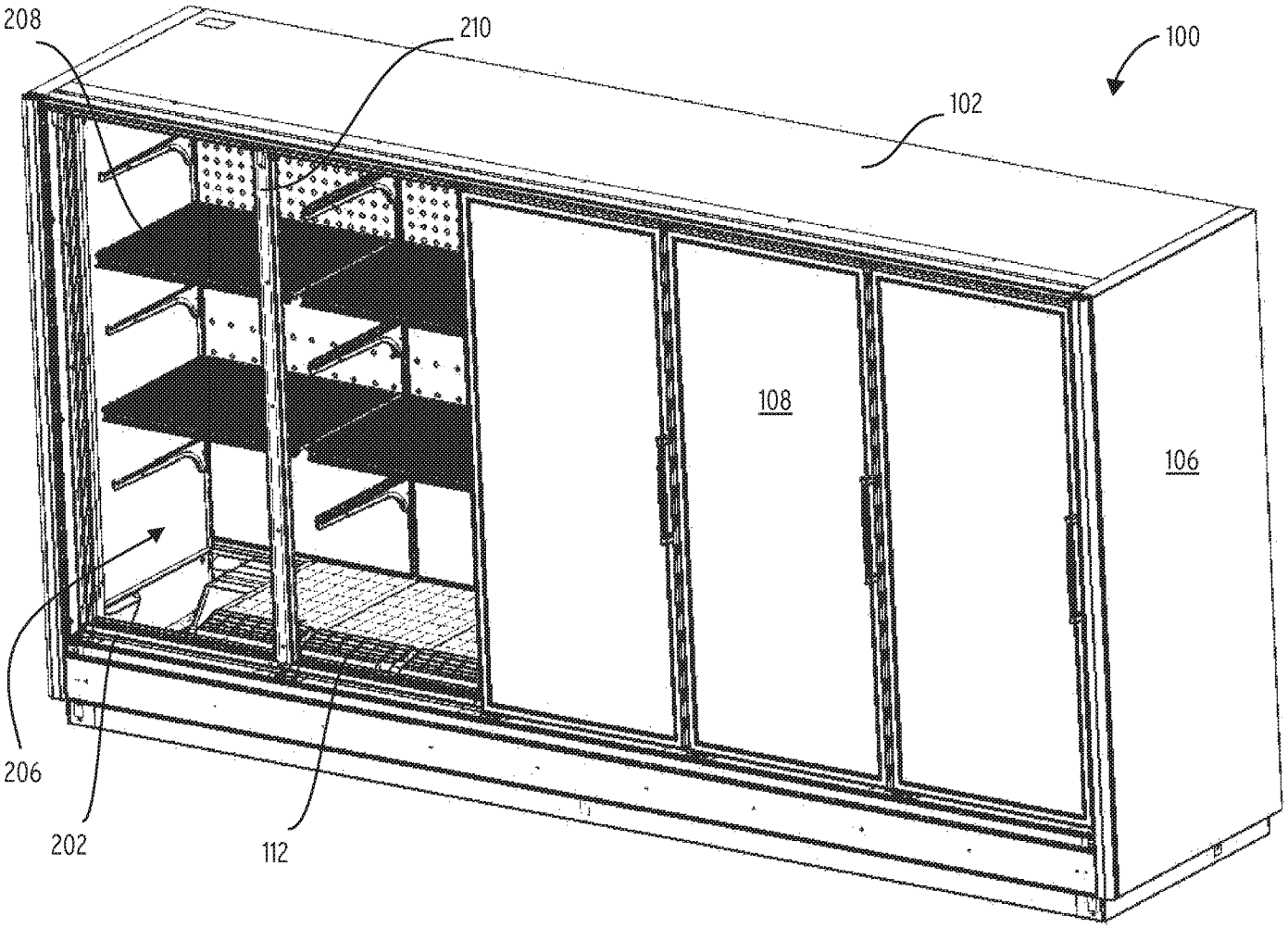
FIG. 2 is a perspective view of the refrigerated case of FIG. 1 with two of the doors removed to better illustrate the refrigerated space.

Turning to FIG. 2, the refrigerated case 100 of FIG. 1 is illustrated with the first door 108 and the second door removed to expose the refrigerated space 206. In the illustrated construction, a plurality of movable shelves 208 are positioned within the refrigerated space 206 to support product to be displayed and sold.

A first mullion 210 is positioned in the open space between the insulated ceiling member 102 and the insulated floor member 112 to break the opening into the refrigerated case 100 into smaller spaces and to provide a surface on which the door 108 can form a portion of the necessary seal when in the closed position. Similar mullions 210 are positioned between each adjacent door 108 to form the necessary seals. Thus, the construction of FIG. 2 includes four mullions 210. As one of ordinary skill will realize, the number of mullions 210 will vary with the number of doors 108 as may be required to achieve the necessary seals. Thus, a construction that includes two doors 108 would include one mullion 210, while a construction with seven doors 108 would include six mullions 210.

Figure 3:
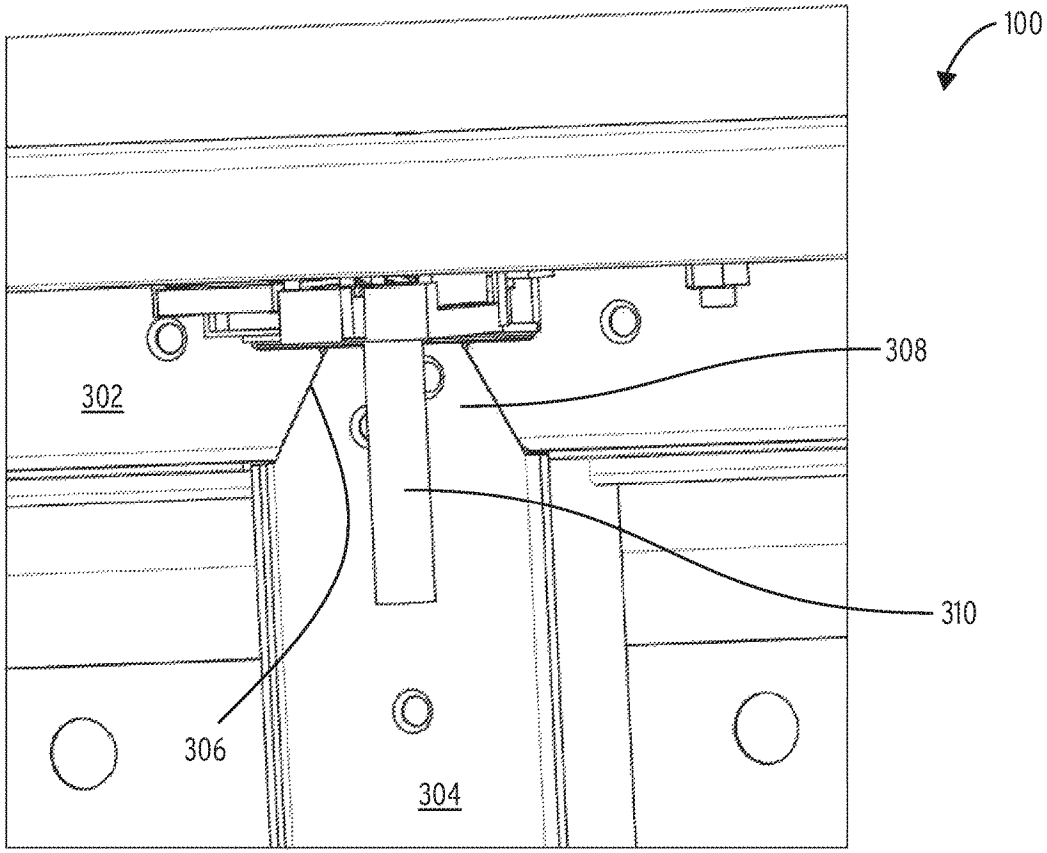
FIG. 3 is an enlarged perspective view of a portion of the refrigerated case of FIG. 2 illustrating a mullion between two doors.

Turning now to FIG. 3, a portion of the refrigerated case 100 is shown enlarged to better illustrate the features. A top end cap 302 defines a front end of the insulated ceiling member 102 and extends the length of the open front of the refrigerated case 100. A bottom end cap 202 (illustrated in FIG. 2) is a substantial mirror image of the top end cap 302. FIG. 3 also illustrates a mullion cap 304 that defines the front end of one mullion 210, with additional mullion caps 304 covering each additional mullion 210. In preferred constructions, the top end cap 302, the mullion caps 304, and the bottom end cap 202 are formed from a metallic material such as steel, stainless steel, or aluminum with other materials being suitable for use. In one construction, a powder coated steel material is used.

FIG. 3 also illustrates a portion of a hinge 310 arranged to support the second door for pivotal movement between the opened position and the closed position. In the illustrated construction, the hinge 310 includes a pin arranged to fit within an aperture formed in the second door. In preferred constructions, the hinge 310 includes a closure member that biases the second door toward the closed position to assure that the second door closes following use by a customer.

Figure 4:
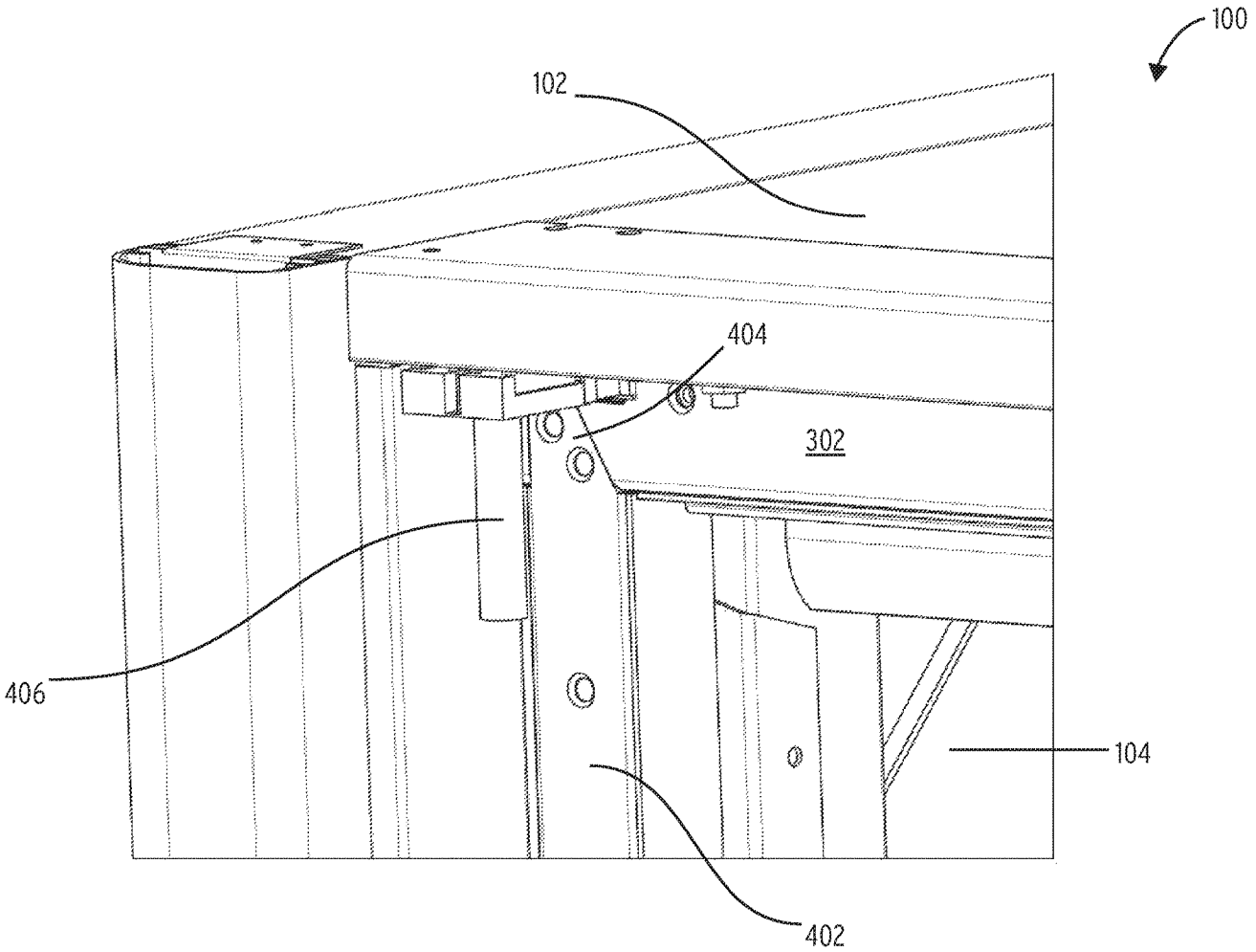
FIG. 4 is an enlarged perspective view of a portion of the refrigerated case of FIG. 2 showing an end wall of the case.

FIG. 4 is an enlarged view of an end of the refrigerated case 100 including the first side wall 104. As illustrated, the top end cap 302 extends into a corner near the first side wall 104. A first side wall end cap 402 defines a front end of the first side wall 104 and defines a portion of the seal surface for the door 108. The second side wall end cap (not shown) is a substantial mirror image of the first side wall end cap 402 and defines a front of the second side wall 106. The first side wall end cap 402 and the second side wall end cap are preferably made from the same material as the top end cap 302.

As illustrated in FIG. 4 a second hinge 406 is positioned adjacent the first side wall 104 to support the door 108 for pivoting movement between the open position and the closed position. The hinge 406 is preferably identical to the hinge 406 positioned near the mullion 210 of FIG. 3.

Figure 5:
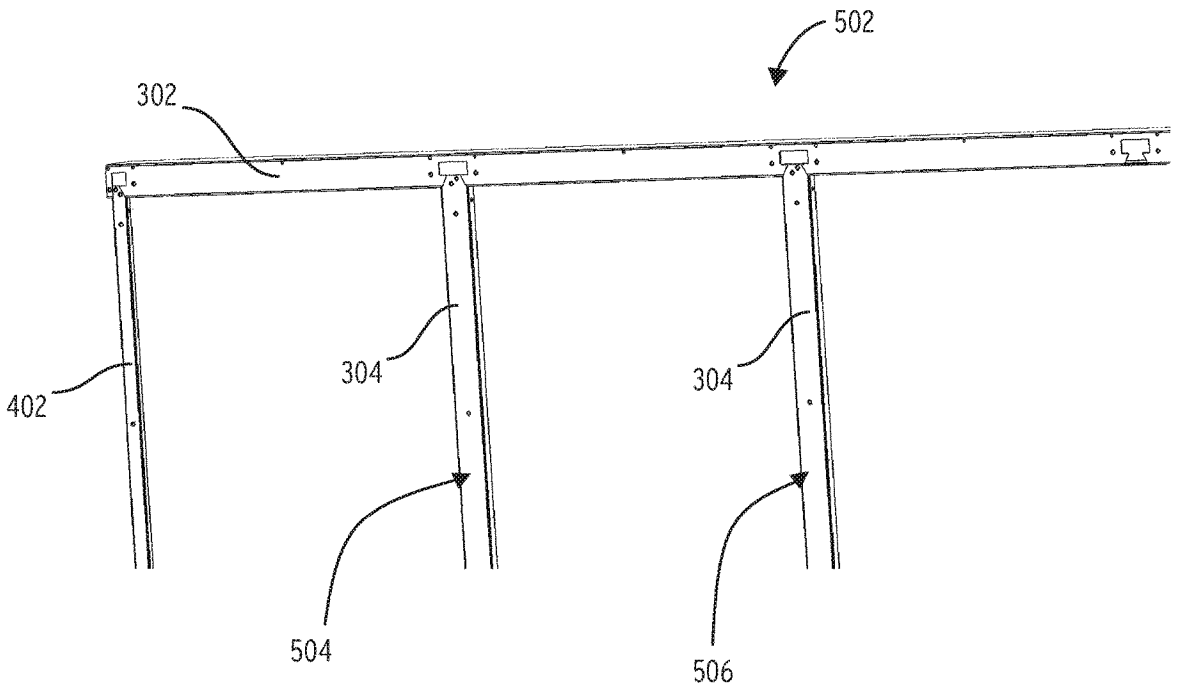
FIG. 5 is a perspective view of a top end cap, a side wall end cap, and two mullion end caps.

FIG. 5 illustrates one quadrant of a seal surface 502 that is defined by the cooperation of the top end cap 302, the first side wall end cap 402, each of the mullion caps 304, the bottom end cap 202, and the second side wall end cap. The seal surface 502 defines a substantially planar surface that includes a first planar sealing surface 504 arranged to form a seal with the door 108 and a second planar sealing surface 506 arranged to form a seal with the second door. Each of the first planar sealing surface 504 and the second planar sealing surface 506 is a substantially continuous rectangular surface with only small gaps between the adjacent components that make up the particular first planar sealing surface 504 or second planar sealing surface.

The seal surface 502 is arranged to define additional planar sealing surfaces as may be required for the various doors provided on the refrigerated case 100. It is important to note that none of the top end cap 302, the first side wall end cap 402, each of the mullion caps 304, the bottom end cap 202, or the second side wall end cap are directly connected to one another (thus providing small gaps therebetween or direct end-to-end contact without a physical connection). Rather, each component is directly attached to the insulated ceiling member 102, the insulated floor member 112, the first side wall 104, the second side wall 106, or one of the mullions 214. In the illustrated construction, countersunk screws are used to complete the attachment with other designs being possible.

Figure 6:
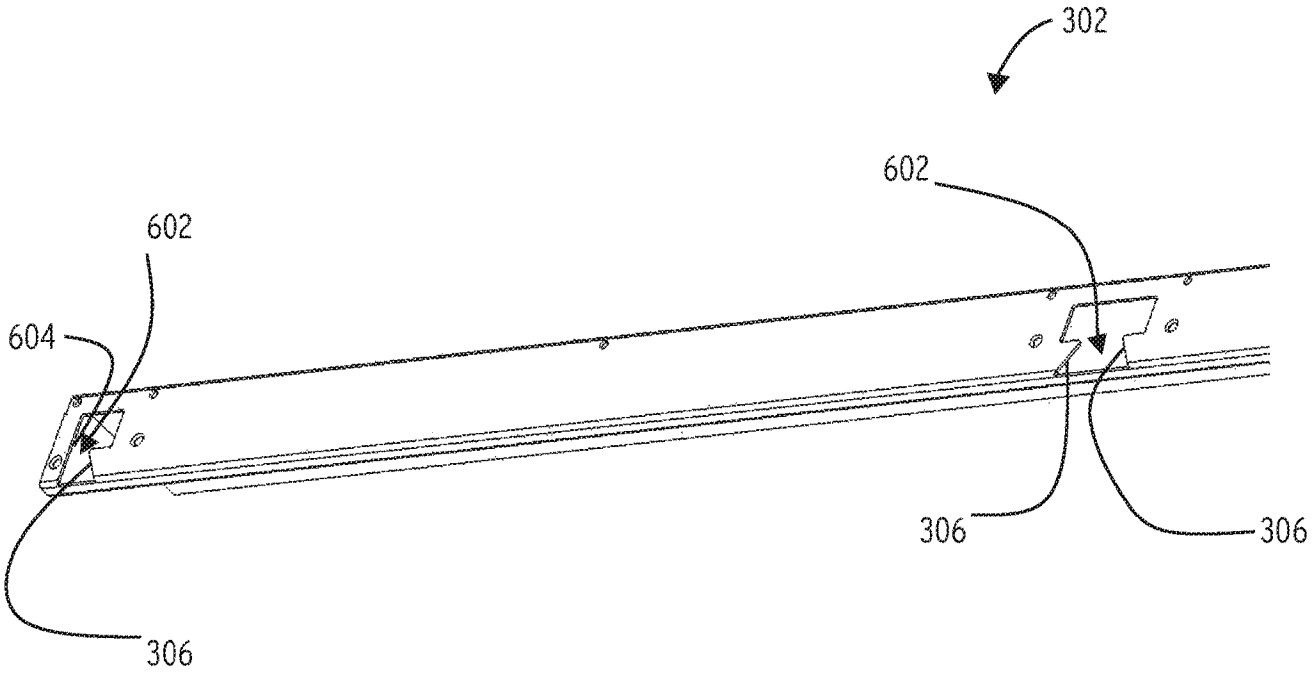
FIG. 6 is a perspective view of a top end cap with the bottom end cap being a substantial mirror image thereof.

FIG. 6 illustrates a portion of the top end cap 302 with all other components removed. The top end cap 302 includes a first aperture 602 adjacent the first side wall 104 and a second aperture 602 adjacent the first mullion 210. While not illustrated, an aperture 602 is positioned adjacent each mullion 210 and adjacent the second side wall 106.

Each aperture 602 includes an open lower edge and at least on edge 306 angled obliquely with respect to the open edge. The aperture 602 adjacent the first side wall 104 includes a second edge 604 that extends normal to the open lower edge while the aperture 602 adjacent each mullion 210 includes a second oblique edge 306. Thus, at least a portion of the aperture 602 is substantially trapezoidal.

Figure 7:
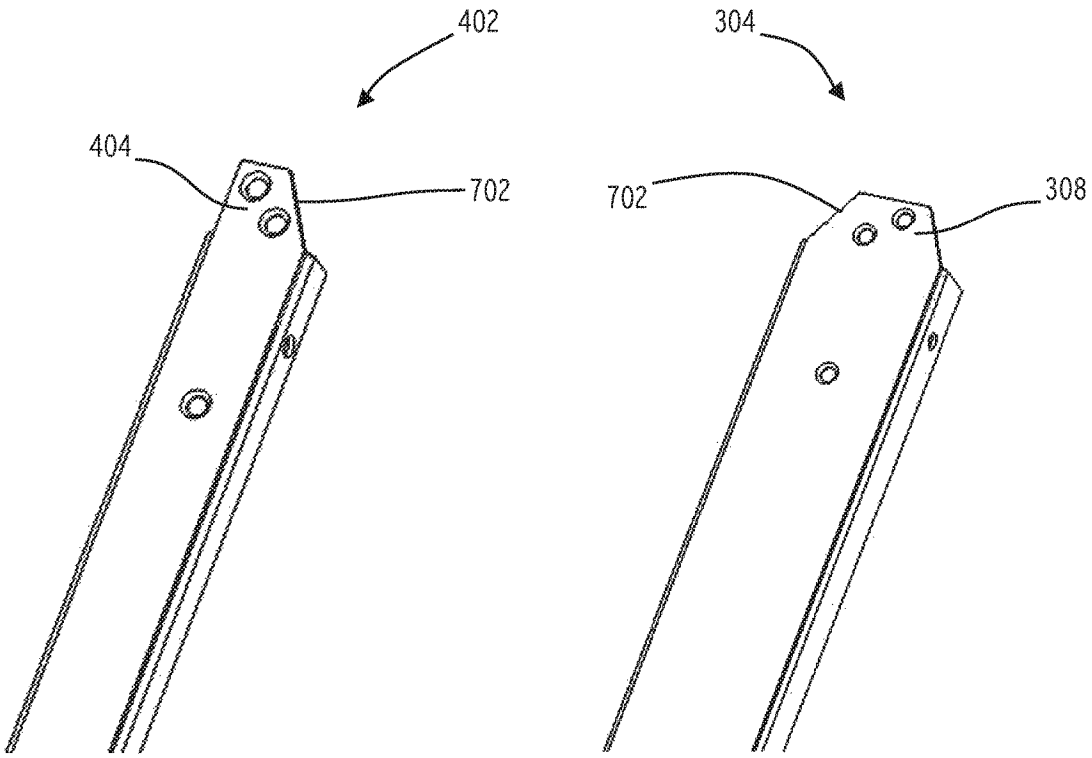
FIG. 7 is a perspective view of a first side wall end cap and a mullion cap.

FIG. 7 illustrates one end of each of the first side wall end cap 402 and the mullion cap 304. As illustrated, the mullion cap 304 includes a tongue portion 308 that is trapezoidal in shape and includes two angled edges 702 that substantially match the edges 306 of the aperture 602. Similarly, the first side wall end cap 402 includes a tongue portion 404 that is trapezoidal in shape and has an angled edge 702 and a straight edge 604 that substantially matches the aperture 602 in the end of the top end cap 302.

The tongues 308, 404 each have a thickness that matches the thickness of the top end cap 302 and the bottom end cap 202 to assure that when received in the respective apertures 602, the tongues 308, 404 and the top end cap 302 and the bottom end cap 202 are substantially flush.

To assemble the refrigerated case 100 the insulated ceiling member 102, the insulated floor member 112, the first side wall 104, and the second side wall 106 are first formed. As mentioned, in preferred constructions, each is made from an insulating foam material with other constructions being possible. The insulated ceiling member 102, the insulated floor member 112, the first side wall 104, and the second side wall 106 are then attached to one another to partially enclose the refrigerated space 206. A rear wall (not shown) completes the enclosure of the refrigerated space 206. In preferred constructions, a support structure provides structural support for the various insulated walls. In preferred constructions, the insulated floor member 112 is elevated to provide space for equipment below the insulated floor member 112 and above the floor supporting the refrigerated case 100.

The top end cap 302 is attached to the insulated ceiling member 102 to complete the insulated ceiling member 102 and the bottom end cap 202 is attached to the insulated floor member 112 to complete the insulated floor member 112. In the illustrated construction, countersunk screws (not shown) are used to complete the attachments. The first side wall end cap 402 is then attached to the first side wall 104 and the second side wall end cap is attached to the second side wall 106. The trapezoidal apertures 602 in the top end cap 302 and the bottom end cap 202 are arranged to receive the tongue portion 404 of the first side wall end cap 402 and the second side wall end cap, while providing some freedom of alignment to accommodate manufacturing tolerances. Thus, a close mating fit between the side wall end caps 402 and the top end cap 302 and the bottom end cap 202 can be achieved at a greatly reduced cost. Similarly, each mullion cap 304 is attached to its respective mullion 210. The trapezoidal tongue portions 308 of each mullion caps 304 are arranged to fit within the apertures 602 of one of the top end cap 302 or the bottom end cap 202. Again, the trapezoidal tongue portions 308, 404 and apertures 602 cooperate to accommodate manufacturing tolerances while achieving a close substantially air tight fit.

Figure 8:
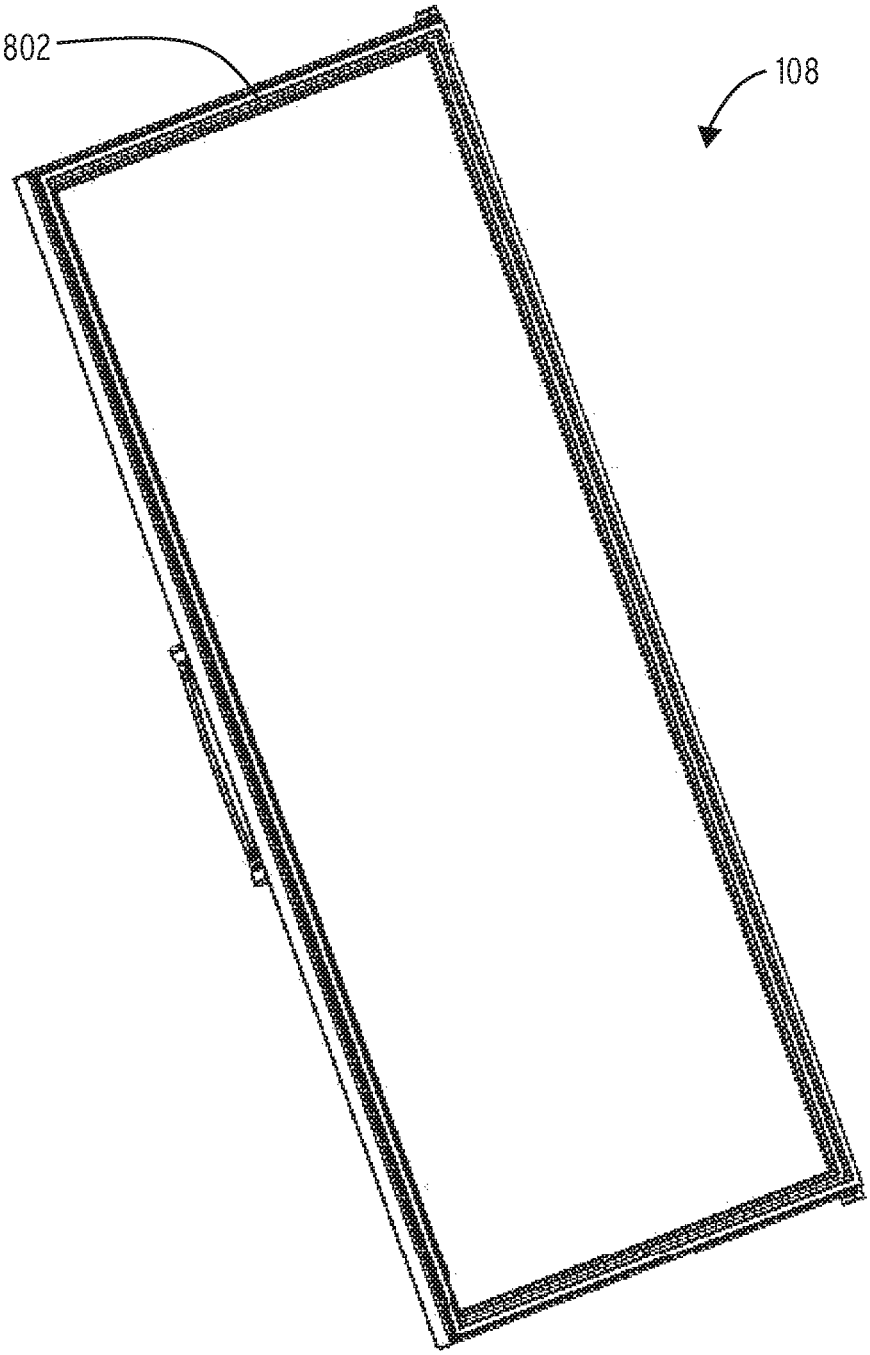
FIG. 8 is a perspective view of a door.

Each door 108 is then attached to the support frame of the refrigerated case 100 to complete the assembly. Each door 108 includes a perimeter seal surface 802 (shown in FIG. 8) that forms a substantially air tight seal with some of the top end cap 302, the bottom end cap 202, the first side wall end cap 402, the second side wall end cap, or one or more of the mullion caps 304 when in the closed position. More specifically, the perimeter seal surface 802 of each door 108 extends around the perimeter of the door 108 and is arranged to form a substantially air tight seal with one of the first planar sealing surface 504, the second planar sealing surface 506 or another planar sealing surface defined by some of the top end cap 302, the bottom end cap 202, the first side wall end cap 402, the second side wall end cap, or one or more of the mullion caps 304.

Various features and advantages of the invention are set forth in the following claims.

What is claimed is:

1. A refrigerated case comprising:

an insulated ceiling member defining a top of a refrigerated space;

an end cap defining a front surface of the insulated ceiling member, the end cap including an aperture having an opening at a bottom edge of the end cap, the aperture coplanar with the front surface of the end cap, the aperture including at least one oblique edge oriented at an oblique angle relative to the bottom edge;

a mullion arranged substantially normal to the insulated ceiling member;

a mullion cap defining a front of the mullion, the mullion cap including a tongue portion extending above the mullion, the tongue portion including at least one oblique edge arranged to mate with the oblique edge of the aperture when the tongue portion is fit within the aperture, the tongue portion coplanar with the aperture and a front surface of the mullion cap, the mullion cap, the tongue portion, and the end cap cooperating to partially define a first planar sealing surface; and a door pivotably attached to the refrigerated case and including a second planar sealing surface, the second planar sealing surface engageable with the first planar sealing surface when the door is in a closed position to define a substantially air tight seal therebetween.

2. The refrigerated case of claim 1, wherein the end cap and the mullion cap do not directly attach to one another.

3. The refrigerated case of claim 1, wherein the aperture includes two edges that are obliquely angled with respect to the bottom edge.

4. The refrigerated case of claim 3, wherein the aperture is substantially trapezoidal, and wherein the opening at the bottom edge of the end cap defines a long edge of a trapezoid.

5. The refrigerated case of claim 4, wherein the tongue portion is trapezoidal.

6. The refrigerated case of claim 1, further comprising a first side wall that defines a side of the refrigerated space and an insulated floor member that defines a bottom of the refrigerated space.

7. The refrigerated case of claim 6, further comprising a first side wall end cap defining a front of the first side wall and a bottom end cap defining a front of the insulated floor member, and wherein the top end cap, the first side wall end cap, the mullion cap, and the bottom end cap cooperate to define the first planar sealing surface.

8. The refrigerated case of claim 7, wherein the first planar sealing surface is a complete rectangular surface and the second planar sealing surface is a complete rectangular surface that forms an air tight seal with the first planar sealing surface when the door is in the closed position.

9. The refrigerated case of claim 7, wherein none of the top end cap, the first side wall end cap, the mullion cap, and the bottom end cap are directly connected to one another.

10. A refrigerated case comprising:

an insulated ceiling member defining a top of a refrigerated space;

an insulated floor member defining a bottom of the refrigerated space;

a first side wall and a second side wall, each of the first side wall and the second side wall defining a side of the refrigerated space;

a mullion arranged substantially normal to the insulated ceiling member;

a top end cap defining a front of the insulated ceiling member, the top end cap including a first end aperture, a second end aperture, and a top mullion aperture, each of the first end aperture, the second end aperture and the top mullion aperture having an opening at a bottom edge of the top end cap, each of the first end aperture, the second end aperture, and the top mullion aperture including at least one oblique edge oriented at an oblique angle relative to the bottom edge;

a bottom end cap defining a front of the insulated floor member, the bottom end cap including a third end aperture, a fourth end aperture, and a bottom mullion aperture, each of the third end aperture, the fourth end aperture and the bottom mullion aperture having an opening at a top edge of the bottom end cap, each of the third end aperture, the fourth end aperture, and the bottom mullion aperture including at least one oblique edge oriented at an oblique angle relative to the top edge;

a mullion cap defining a front of the mullion, the mullion cap including a top tongue portion extending above the mullion and a bottom tongue portion extending below the mullion, the top tongue portion including at least one oblique edge arranged to mate with the oblique edge of the top mullion aperture when the top tongue portion is fit within the top mullion aperture and the bottom tongue portion including at least one oblique edge arranged to mate with the oblique edge of the bottom mullion aperture when the bottom tongue portion is fit within the bottom mullion aperture, the top tongue portion positioned in a plane with the top end cap, the bottom tongue portion positioned in a plane with the bottom end cap;

a first side wall end cap defining a front of the first side wall, the first side wall end cap including a top first side tongue portion and a bottom first side tongue portion, the top first side tongue portion including at least one oblique edge arranged to mate with the oblique edge of the first end aperture when the top first side tongue portion is fit within the first end aperture and the bottom first side tongue portion including at least one oblique edge arranged to mate with the oblique edge of the third end aperture when the bottom first side tongue portion is fit within the third end aperture;

a second side wall end cap defining a front of the second side wall, the second side wall end cap including a top second side tongue portion and a bottom second side tongue portion, the top second side tongue portion including at least one oblique edge arranged to mate with the oblique edge of the second end aperture when the top second side tongue portion is fit within the second end aperture and the bottom second side tongue portion including at least one oblique edge arranged to mate with the oblique edge of the fourth end aperture when the bottom second side tongue portion is fit within the fourth end aperture, the top end cap, the bottom end cap, the mullion cap, the first side wall end cap, and the second side wall end cap cooperating to define a first planar sealing surface; and a door pivotably attached to the refrigerated case and including a second planar sealing surface, the second planar sealing surface engageable with the first planar sealing surface when the door is in a closed position to define a substantially air tight seal therebetween.

11. The refrigerated case of claim 10, wherein the first side wall end cap, the top end cap, the mullion cap, and the bottom end cap cooperate to define a first rectangular sealing surface, and the second side wall end cap, the top end cap, a second mullion cap, and the bottom end cap cooperate to define a second rectangular sealing surface.

12. The refrigerated case of claim 11, wherein the door is a first door and wherein the second planar sealing surface forms a substantially air tight seal with the first rectangular sealing surface, and wherein a second door includes a third planar sealing surface that forms a substantially air tight seal with the second rectangular sealing surface.

13. The refrigerated case of claim 10, wherein none of the top end cap, the bottom end cap, the mullion cap, the first side wall end cap, and the second side wall end cap are directly connected to one another.

14. A refrigerated case comprising:

a frame including an insulated ceiling member and at least one mullion oriented substantially normal to the insulated ceiling member, the frame defining a refrigerated space;

an end cap defining a front surface of the insulated ceiling member and coupled to the insulated ceiling member;

a mullion cap defining a front surface of the mullion, the mullion cap coupled to the mullion and supported on the frame independently of the end cap;

an aperture positioned on one of the end cap and the mullion cap, the aperture forming an opening positioned along an edge of the one of the end cap and the mullion cap, the aperture being coplanar with the front surface of the one of the end cap and the mullion cap, the aperture including at least one oblique edge oriented at an oblique angle relative to the edge of the one of the end cap and the mullion cap;

a tongue portion protruding from the other of the end cap and the mullion cap, the tongue portion including at least one oblique edge arranged to mate with the oblique edge of the aperture when the tongue portion is fit within the aperture, the tongue portion coplanar with the aperture and the front surface of the other of the end cap and the mullion cap, the mullion cap and the end cap cooperating to partially define a first planar sealing surface; and a door pivotably attached to the refrigerated case and including a second planar sealing surface, the second planar sealing surface engageable with the first planar sealing surface when the door is in a closed position to define a substantially air tight seal therebetween.

15. The refrigerated case of claim 14, wherein the aperture includes two edges that are obliquely angled with respect to a longitudinal axis of the mullion.

16. The refrigerated case of claim 14, wherein the aperture is substantially trapezoidal, and wherein the tongue portion is substantially trapezoidal.

17. The refrigerated case of claim 14, wherein the frame further includes a first side wall that defines a side of the refrigerated space and an insulated floor member that defines a bottom of the refrigerated space, and further comprising a first side wall end cap defining a front of the first side wall and a bottom end cap defining a front of the insulated floor member, and wherein the top end cap, the first side wall end cap, the mullion cap, and the bottom end cap cooperate to define the first planar sealing surface.

18. The refrigerated case of claim 17, wherein the first planar sealing surface is a complete rectangular surface and the second planar sealing surface is a complete rectangular surface that forms an air tight seal with the first planar sealing surface when the door is in the closed position.

19. The refrigerated case of claim 17, wherein the top end cap, the first side wall end cap, the mullion cap, and the bottom end cap are supported on the frame independently of one another.

20. The refrigerated case of claim 14, wherein the aperture is formed on the end cap and the tongue portion is formed as part of the mullion cap.

* * * * *